US005631435A

United States Patent [19]

Hutmacher

[11] Patent Number: 5,631,435

[45] Date of Patent: May 20, 1997

[54] ELECTRO-MECHANICAL TREMOLO APPARATUS FOR AN ELECTRIC GUITAR

[76] Inventor: Eric Hutmacher, 1770 N. Green Valley Pkwy., Apt. 2612, Henderson, Nev. 89014

[21] Appl. No.: 370,824

[22] Filed: Jan. 18, 1995

[51] Int. Cl.[6] ..... G10D 3/00; G10H 1/055

[52] U.S. Cl. ..... 84/739; 84/313; 84/DIG. 19

[58] Field of Search ..... 84/645, 739, 740, 84/313, DIG. 19

[56] References Cited

U.S. PATENT DOCUMENTS

| | | | |
|---|---|---|---|
| 4,100,832 | 7/1978 | Peterson . | |
| 4,516,462 | 5/1985 | Schulze | 84/739 |
| 4,580,479 | 4/1986 | Bonanno | 84/645 X |
| 4,608,906 | 9/1986 | Takabayashi . | |
| 4,621,557 | 11/1986 | Newell . | |
| 4,763,555 | 8/1988 | Minakuchi et al. . | |
| 5,083,492 | 1/1992 | Gorr . | |
| 5,085,120 | 2/1992 | Ishiguro | 84/739 X |
| 5,099,742 | 3/1992 | Meno | 84/739 X |

*Primary Examiner*—Stanley J. Witkowski
*Attorney, Agent, or Firm*—Quirk & Tratos

[57] ABSTRACT

In a first embodiment, a columnated light beam is transmitted to a lens aperture of continuously variable size. The lens aperture is coupled to the tremolo arm of a solid body electric guitar. Light from the lens aperture is focussed upon a photosensitive surface of a photo-transistor. The photo-transistor provides a tremolo voltage that is an analog of the position of the tremolo arm. In a second embodiment, a potentiometer has its shaft coupled to the tremolo arm. The wiper arm of the potentiometer provides the tremolo voltage.

3 Claims, 3 Drawing Sheets

ELECTRO-MECHANICAL TREMOLO APPARATUS FOR AN ELECTRIC GUITAR

BACKGROUND OF THE INVENTION

1. Field of Invention

This invention is in the general field of solid-body electric guitars and, more particularly, is an apparatus and method for causing a tremolo effect on sound produced by a solid-body electric guitar in response to positioning a tremolo arm that is mounted on the body of the guitar.

2. Background of the Invention

A solid-body electric guitar is an almost purely electronic instrument. One or more pickups are connected to each of the strings of the solid-body guitar. In response to vibration of the strings, the pickups generate electrical signals that are combined and amplified to provide an audio signal that drives one or more loudspeakers.

Very little energy of vibration is transferred from the strings. Therefore, string vibration is sustained longer than corresponding vibration in other string instruments. As a result, a solid-body guitar sound caused by plucking a string is sustained longer than sound provided by the other string instruments.

A guitarist may choose to cause a tremolo effect whereby the pitch of the solid-body guitar sound is changed during the time that it is sustained. In one type of solid-body guitar, the tremolo effect is attained in response to the guitarist operating a foot pedal that is coupled to a potentiometer. A signal from the potentiometer causes a modification of the audio signal that results in the tremolo effect.

In another type of solid-body guitar, the tremolo effect is attained in response to the guitarist manually changing the position of a tremolo arm that is connected to a bridge over which the strings pass. Changing the position of the tremolo arm causes a corresponding change in the position of the bridge. The change in the position of the bridge changes the tension of the strings, thereby changing the tuning of the strings. Typically, the tremolo arm is connected to springs that provide the guitarist with tactile feedback of the position of the tremolo arm.

Most guitarists prefer to manually change the position of the tremolo arm rather than operate the foot pedal. In particular, foot pedals are difficult to control, as a user has more control over his arm/hand than his foot. Further, during concerts and the like, the presence of a foot pedal may be dangerous when left on a stage where a band member may trip on it. Alternatively, even when left on a stage, because the guitarist is often moving around, the foot pedal is often not in the desired location for use.

On the other hand, while a guitar-mounted mechanical tremolo is preferred, these current tremolos have the disadvantage of changing the tension of the strings to attain the tremolo effect, rapidly causes an undesired detuning of the strings. This can result in detuning of a guitar during a concert or the like, forcing the guitarist to change guitars or retune in the middle of the concert.

SUMMARY OF THE INVENTION

An object of the present invention is to provide a solid-body electric guitar where a tremolo effect is achieved without changing the tension of strings of the guitar, and where the means for achieving the tremolo effect are located directly on the guitar.

According to the present invention, a tremolo signal that is an analog of the position of a tremolo arm of a solid-body electric guitar causes a modification of an audio signal that is produced in response to plucking a string of the guitar.

A solid-body guitar, in accordance with the invention, utilizes a tremolo arm for producing a tremolo effect. However, changing the position of the tremolo arm does not change the tension of strings of the guitar.

Other objects, features, and advantages of the invention will be apparent from the following description of embodiments thereof as illustrated in the accompanying drawing.

DETAILED DESCRIPTION OF THE PREFERRED EMBODIMENT

Figure 1:
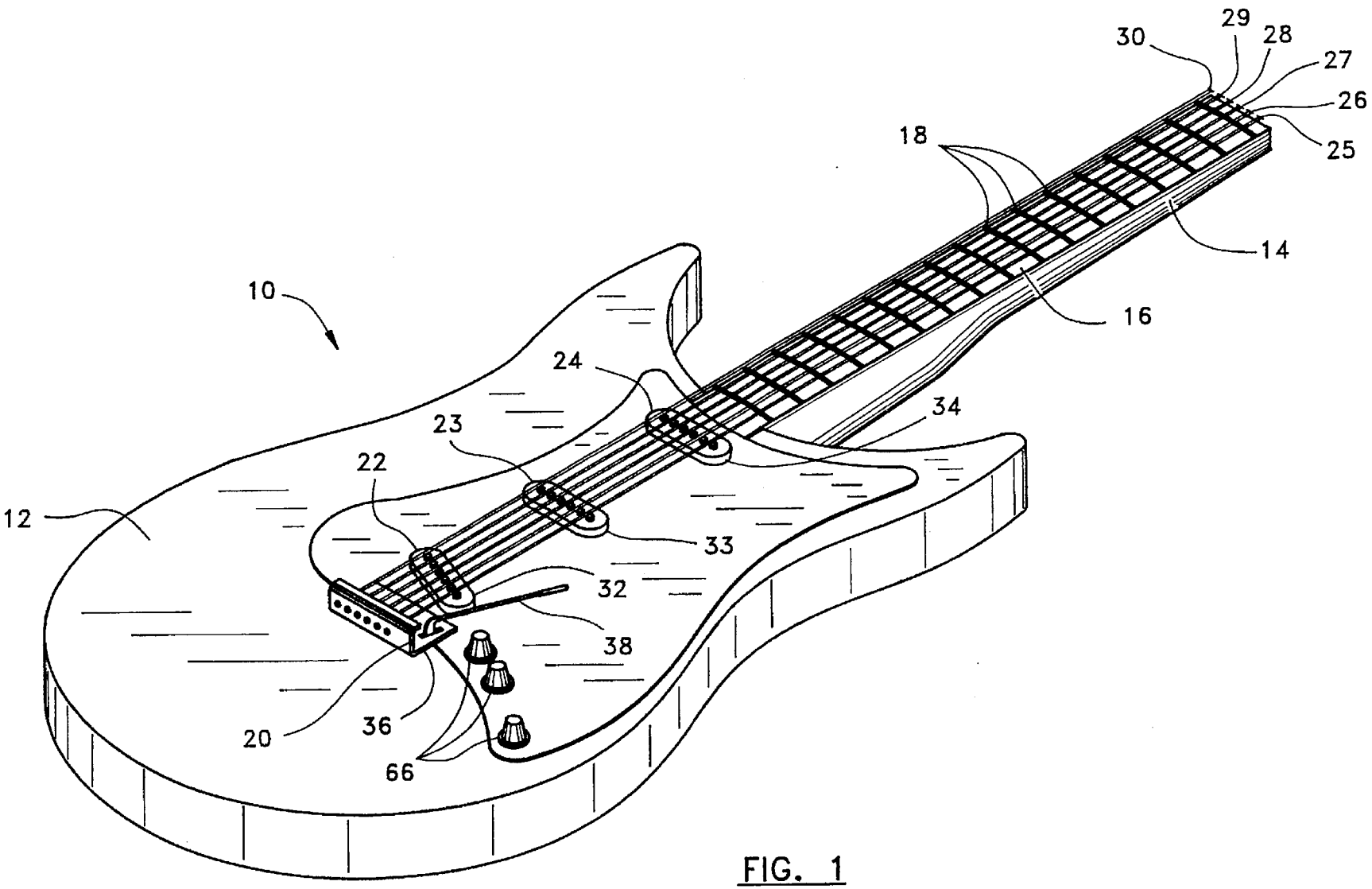
FIG. 1 is a perspective view, with parts broken away, of a solid-body electric guitar in accordance with the embodiments of the present invention.

As shown in FIG. 1, a solid-body electric guitar 10 has a body 12 that is connected to a neck 14 whereon a fingerboard 16 carries frets 18. Body 12 additionally has a bridge 20 mounted thereon and groups of pickups 22, 23, 24.

Bridge 20 is fixedly connected to proximal ends of guitar strings 25–30. Distal ends of strings 25–30 are connected to a head (not shown) of guitar 10. String 25 passes over fingerboard 16 and is connected to a pickup 32 of group 22, a pickup 33 of group 23 and a pickup 34 of group 24. In a similar manner, strings 26–30 are connected to pickups of groups 22, 23, 24. Pickups are well known to those skilled in the art. Additionally mounted on body 12 (FIG. 1) are potentiometers 66 that are used as volume and tone controls.

Body 12 is connected via a pivot mounting fixture 36 to a tremolo arm 38. The arm 38 includes a first portion 41 for engagement by a user. Preferably, this portion 41 of the arm 38 has the same shape and size as currently used tremolo arms, so as to be visually indistinguishable therefrom. A second portion 43 of the arm 28 extends inside of a hollow portion of the guitar body 12. The arm 38 is mounted on a pivot 45 so that movement of the first portion 41 of the arm 38 effectuates movement of said second portion 43 of said arm. Alternate mountings or means may be employed for effectuating movement of said second portion of said arm in response to movement of said first portion.

Although a guitarist moves tremolo arm 38 to attain a tremolo effect, the tension of strings 25–30 is independent of the position of tremolo arm 38 for reasons explained hereinafter. In particular, the second portion 43 of the arm 38 is connected to means for manipulating the output of the guitar.

Figure 2:
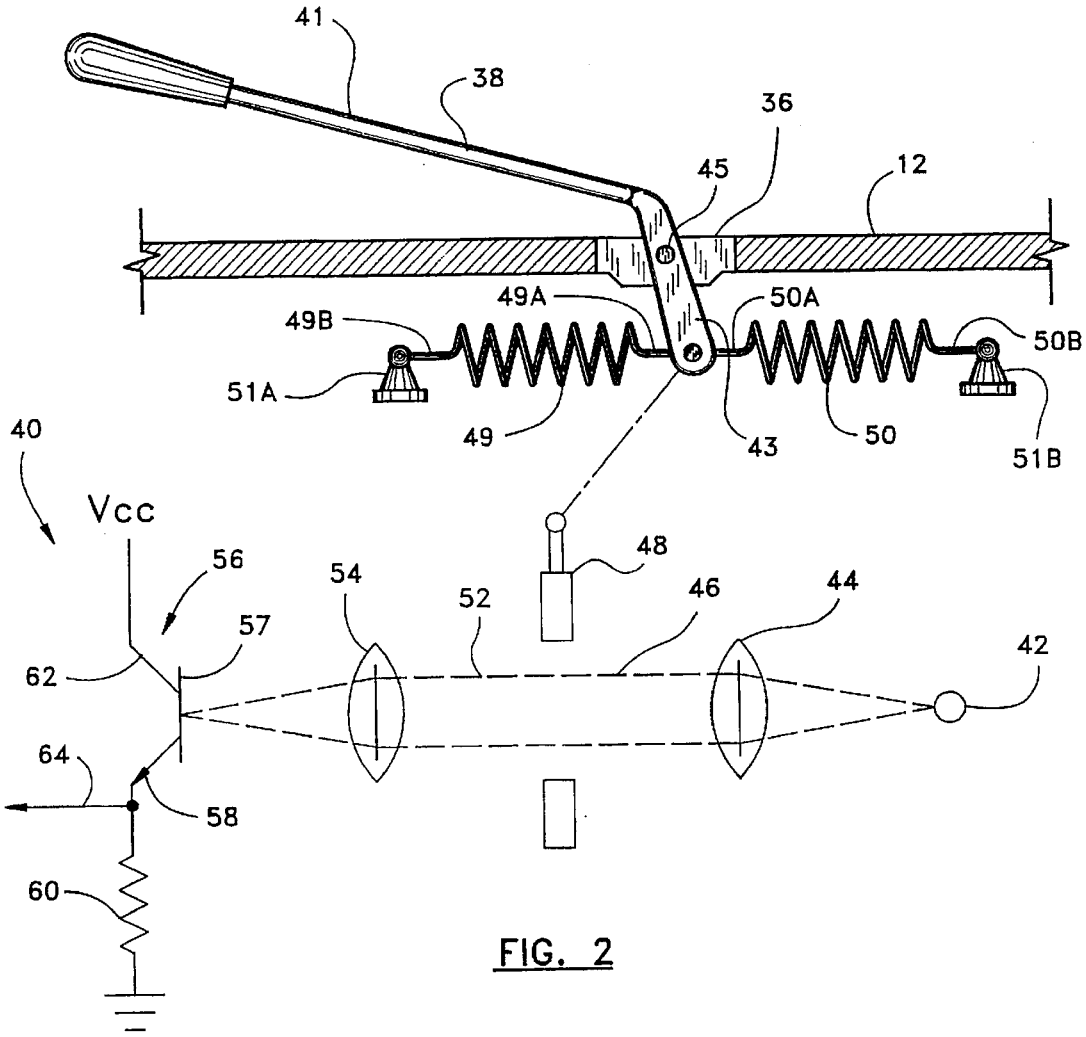
FIG. 2 is a schematic showing of a tremolo signal generator of in accordance with a first embodiment of the present invention.

As shown in FIG. 2, within a hollow portion of body 12 is a tremolo signal generator 40 in accordance with a first embodiment of the present invention. Generator 40 includes a light emitting diode (LED) 42 and a lens 44 disposed with a distance therebetween substantially equal to the focal length of lens 44. In response to light from LED 42, lens 44 transmits a columnated light beam 46. A lens aperture 48 is disposed along the path of beam 46, whereby beam 46 is transmitted to lens aperture 48. Columnation of light is well known to those skilled in the art.

Figure 2A:
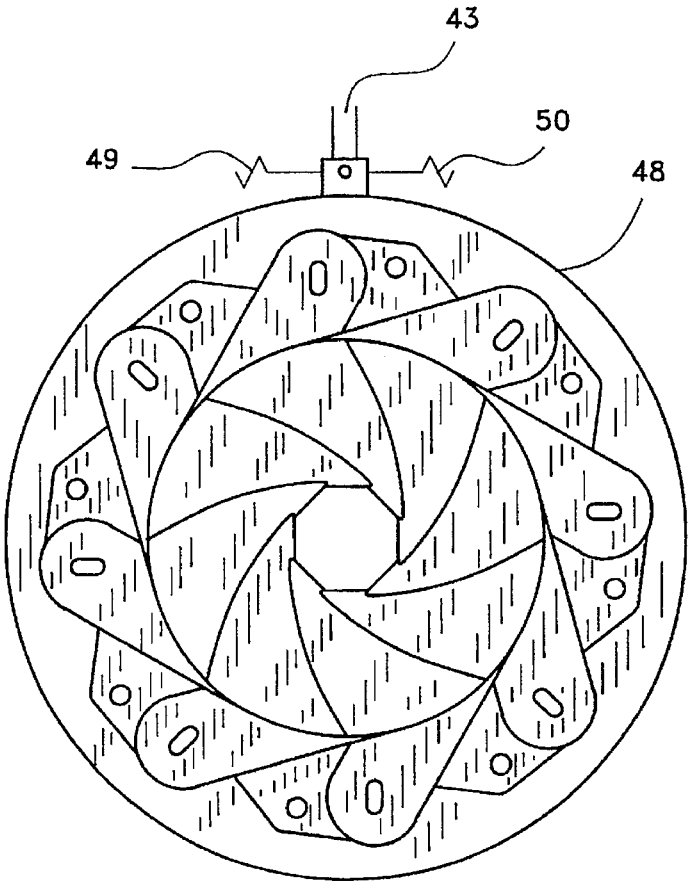
FIG. 2*a* is a front view of a lens aperture for use in the tremolo signal generator of FIG. 2.

Lens aperture 48, as best seen in FIG. 2*a*, is formed by an iris diaphragm comprised of thin overlapping leaves that fold together to create a through hole of continuously variable size. In this embodiment, tremolo arm 38 is mechanically coupled to lens aperture 48 by a pin. It is noted that the orientation of the aperture 48 and arm 38 in FIG. 2 is off by 90 degrees (the true orientation is illustrated in FIG. 2*a*) in order that the orientation of the aperture to the beam 48 may be shown.

Tremolo arm 38 is operable to change the size of the through hole. Moreover, the coupling of the second portion of the tremolo arm 38 to lens aperture 48 is of a type that causes the size of the through hole to be an analog of the position of tremolo arm 38.

Additionally, means are provided for biasing the arm 389 into a neutral position. In particular, the tremolo arm 38 is mechanically coupled to springs 49, 50 at ends 49A, 50A thereof, respectively. An end 49B, of spring 49 is connected to body 12 through a mounting fixture 51A. Similarly, an end 50B of spring 50 is connected to body 12 through a mounting fixture 51B. Springs 49, 50 provide tactile feedback of the position of tremolo arm 38. Other means for biasing may be provided as known to those skilled in the art.

Since the through hole is of continuously variable size, movement of tremolo arm 38 modulates a transmission of beam 46, whereby a modulated light beam 52 emerges from lens aperture 48. It should be understood that beam 52 is columnated.

In other words, when the through hole is fully open, almost all of beam 46 is transmitted. When the through hole is almost entirely closed, almost all of beam 46 is occluded. Since the size of the through hole is an analog of the position of tremolo arm 38, the amount of light transmitted via beam 52 is an analog of the position of tremolo arm 38. Lens aperture 48, as best illustrated in FIG. 2*a*, is of a type well known in the photographic art.

Beam 52 is transmitted to a lens 54 that is similar to lens 44. Lens 54 and a photo-transistor 56 are disposed to cause a photosensitive surface 57 of photo-transistor 56 and lens 54 to have a distance therebetween substantially equal to the focal length of lens 54. Since beam 52, is columnated, light that is transmitted from lens 54 is focused upon surface 57. It should be understood that the amount of focussed light substantially equals the amount of light transmitted via beam 52.

The emitter 58 of photo-transistor 56 is connected to ground through a resistor 60, thereby providing a path to ground for emitter current of photo-transistor 56. The collector 62 of photo-transistor 56 is connected to a voltage source (not shown) that provides a positive voltage designated as $V_{cc}$.

Emitter 58 provides a tremolo voltage that is proportional to the amount of focussed light. Since the amount of focussed light substantially equals the amount of light transmitted via beam 52 and the amount of light transmitted via beam 52 is an analog of the position of tremolo arm 38, the tremolo voltage is an analog of the position of tremolo arm 38.

Emitter 52 is connected through a signal line 64 to a guitar amplifier (not shown), whereby the tremolo voltage is provided to the guitar amplifier. In concurrent response to the tremolo voltage and signals from pickups of groups 22, 23, 24, the amplifier provides an audio signal representation of a guitar sound with a tremolo effect.

Figure 3:
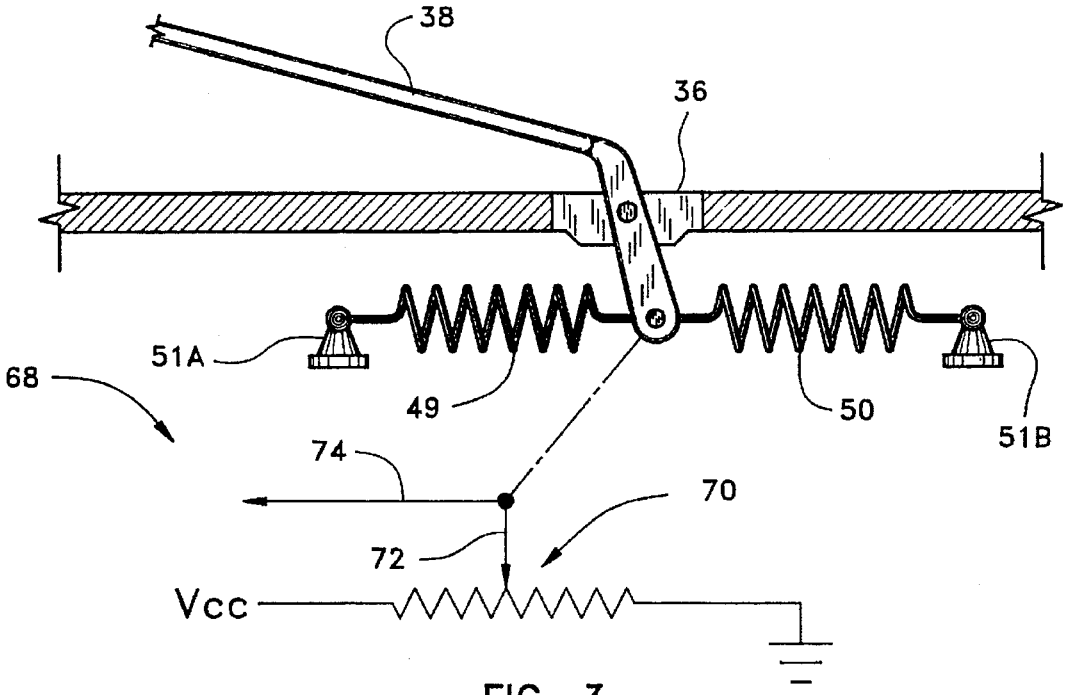
FIG. 3 is a schematic showing of a tremolo signal generator in accordance with a second embodiment of the present invention.

As shown in FIG. 3, in a second embodiment of the present invention, a tremolo signal generator 68 includes a potentiometer 70 that has its shaft mechanically coupled to tremolo arm 38. Additionally, one end of potentiometer 70 is connected to the voltage source that provides the voltage, $V_{CC}$. The other end of potentiometer 70 is connected to ground.

The coupling of potentiometer 70 to tremolo arm 38 is of a type that causes the position of the wiper arm 72 of potentiometer 70 to be an analog of the position of the tremolo arm. Accordingly, wiper arm 72 provides the tremolo voltage described in connection with the first embodiment. Wiper arm 72 is connected through a signal line 74 to the guitar amplifier.

While the invention has been particularly shown and described with reference to embodiments thereof, it should be understood by those skilled in the art that changes in form and detail may be made therein without departing from the spirit and scope of the invention.

I claim:

1. In a solid-body electric guitar of the type that has a body whereon a tremolo arm is pivotally mounted, the improvement comprising:

means for providing tactile feedback of the position of said tremolo arm;

a light source;

a photo-transistor having a photosensitive surface; and means coupled to said light source for focussing upon said photosensitive surface an amount of light that is an analog of the position of said tremolo arm.

2. The guitar of claim 1 wherein said focussing means comprises;

a lens that columnates light from said source;

a lens aperture, having a through hole of continually variable size, that is coupled to said tremolo arm, said aperture being disposed along the path of light from said columnating lens; and a lens that focusses light from said lens aperture upon said photosensitive surface.

3. The guitar of claim 2 wherein said light source is comprised of a light emitting diode.

* * * * *